US005490727A

United States Patent [19]

Pöschl

[11] Patent Number: 5,490,727

[45] Date of Patent: Feb. 13, 1996

[54] DISC-SHAPED MIXING TOOL WITH CONICALLY BEVELED THROUGH BONES

[75] Inventor: Günter Pöschl, Schwaikheim, Germany

[73] Assignee: PPV-Verwaltungs-AG, Zurich, Switzerland

[21] Appl. No.: 373,318

[22] PCT Filed: Jul. 14, 1993

[86] PCT No.: PCT/EP93/01850

§ 371 Date: Jan. 13, 1995

§ 102(e) Date: Jan. 13, 1995

[87] PCT Pub. No.: WO94/02239

PCT Pub. Date: Feb. 3, 1994

[30] Foreign Application Priority Data

Jul. 16, 1992 [DE] Germany ..... 42 23 434.4

[51] Int. Cl.[6] ..... B01F 7/26

[52] U.S. Cl. ..... 366/316; 261/91; 416/181

[58] Field of Search ..... 366/64, 262–265, 366/315–317, 328; 416/181, 231 A, 243; 261/91, 87, 93

[56] References Cited

U.S. PATENT DOCUMENTS

| | | | |
|---|---|---|---|
| 1,727,753 | 9/1929 | De Bethune | 366/316 X |
| 3,069,144 | 12/1962 | Patten | 366/262 X |
| 3,206,173 | 9/1965 | Burger . | |
| 4,007,920 | 2/1977 | Plunguian et al. | 366/264 |
| 4,176,797 | 12/1979 | Kemp . | |
| 4,732,487 | 3/1988 | Pollard | 366/316 X |

FOREIGN PATENT DOCUMENTS

| | | |
|---|---|---|
| 0495506A2 | 1/1992 | European Pat. Off. . |
| 0515732 | 12/1992 | European Pat. Off. . |
| 2167758 | 8/1973 | France . |
| 1196559 | 7/1965 | Germany . |
| 3909371 | 9/1990 | Germany . |
| 4101303A1 | 1/1991 | Germany . |
| 4113578A1 | 4/1991 | Germany . |
| 0376089 | 5/1964 | Switzerland . |

*Primary Examiner*—Charles E. Cooley

*Attorney, Agent, or Firm*—Panitch Schwarze Jacobs & Nadel

[57] ABSTRACT

A disc-shaped mixing tool (11) is used to mix liquids and to dissolve gases in liquids. The mixing tool (11) has a knife-sharp peripheral edge and several axial through bores (17), so that a liquid stream in the form of several cyclones (25) occurs upon rotation of the mixing tool (11). The bores (17) are each conically bevelled both on the upper and on the lower sides (13, 15) and are axially rounded off in the region (27) between the bevels in such a way that a radial airfoil profile (21) and, in a peripheral direction between adjacent bores (17), a peripheral airfoil profile (23) each result. Upon flowing through the bores (17) the liquid is spun radially outwards, resulting in tiny cavitation bubbles at the peripheral edge (19).

10 Claims, 3 Drawing Sheets

Fig. 2
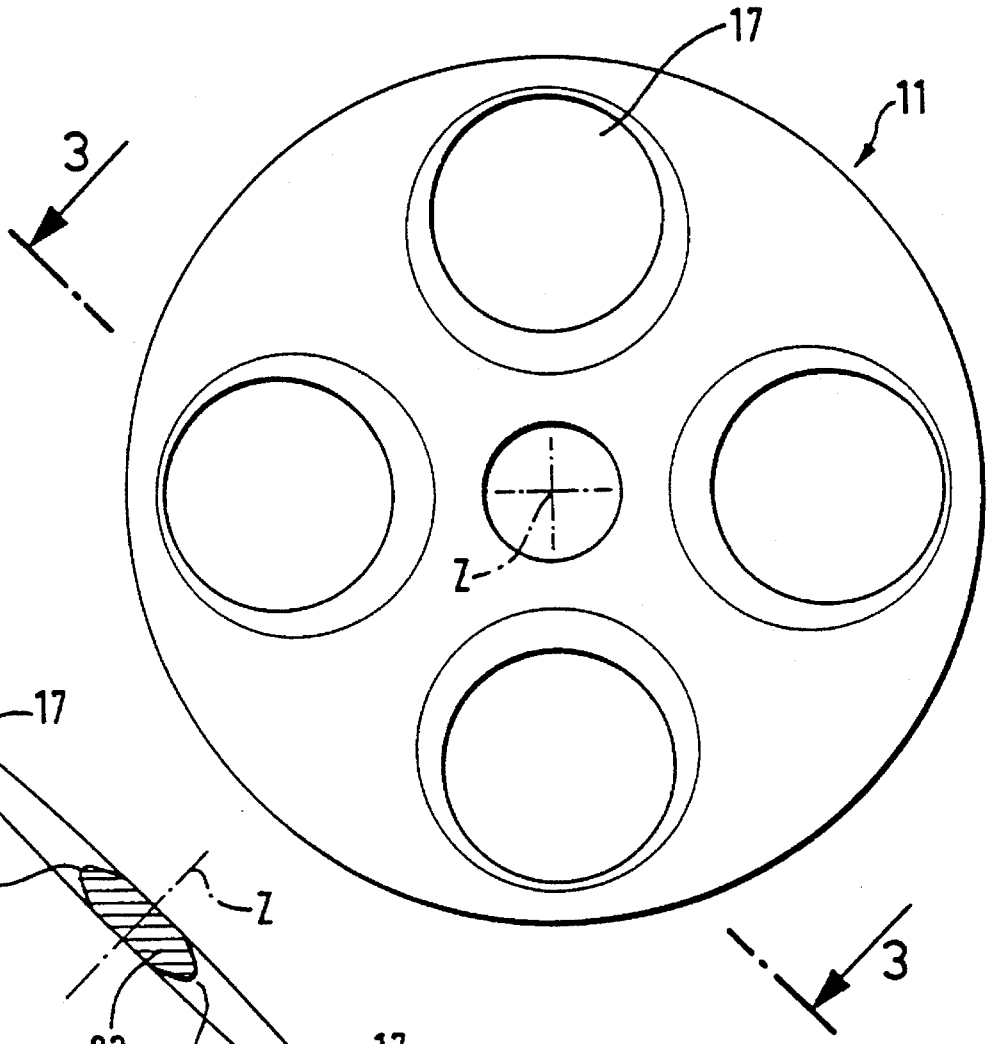
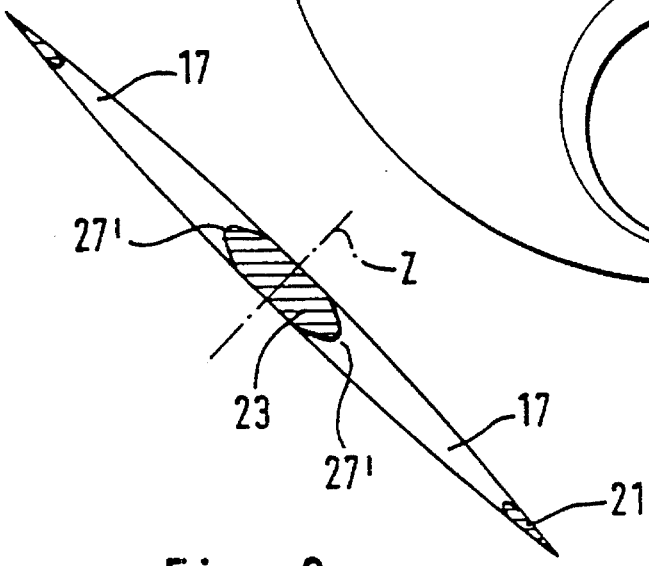
Fig. 3

DISC-SHAPED MIXING TOOL WITH CONICALLY BEVELED THROUGH BONES

TECHNICAL FIELD

This invention refers to a disc-shaped mixing tool having an upper side and a lower side, being rotatable around a central axis and having several axial through bores, with at least one of the two sides of the disc being convex.

BACKGROUND ART

A mixing tool of this kind is already known from U.S. Pat. No. 4,007,920, FIG. 18. This known mixing tool is in the shape of a disc, is rotatable around a central axis, and is provided with several axial through bores, with one of the two sides of the disc being convex. The through bores serve to introduce air adjacent to the upper side of the mixing tool into a liquid adjacent to the lower side of the mixing tool. The mixing effect of this known tool, however, is in need of improvement, since for a thorough mixing of liquid and gas the known mixing tool must rotate for a relatively long time and a large amount of energy is therefore consumed.

Another mixing tool of the type given above is the subject matter of two older, not prepublished proposals of the applicant (EP 0 495 506 A2 and DE 41 13 578 A1). The mixing tool therein is designed as a discus-like disc and has different curvatures on its upper and lower sides. The disc itself is caused to rotate by a drive, so that a pressure difference between the upper and lower sides arises as a result of the Bernoulli effect. As the disc has several axial bores, an axial stream created by the pressure difference occurs between the upper and lower sides. The stream flows through the axial bores, so that an intensive blending of several fluids can take place as a result of the flow from the lower side to the upper side. In addition, the known disc is provided with a knife-sharp peripheral edge to prevent a flow around the disc. At a rotary speed of 3000 to 8000 revolutions per minute and a disc diameter of 42 mm the stream is so strong that cavitation occurs at the peripheral edge of the disc and even gases can be dispersed into the tiniest bubbles and dissolved in fluids, whereby the finest foams, suspensions and emulsions are produced.

Cavitation appearances also occur, for instance, with turbine blades or ship propellers. If a liquid is caused to flow at a high speed, cavities with strong partial vacuums are formed in the liquid. When these cavities implode, pressure thrusts are released, which can cause damage to turbine blades and ship propellers in the form of cavitation erosion or cavitation corrosion.

To be sure, the discs according to the above two older proposals of the applicant have proved themselves in practical application; however, endeavours are being made to further increase their cavitation effect, in order to render the mixing of liquids and/or gases even more rapid and even more thorough.

DISCLOSURE OF INVENTION

The object of the invention is to provide an improved mixing tool for more rapid and more thorough mixture of liquids and/or gases.

In the mixing tool according to the invention, the bores are each conically bevelled at the upper and at the lower side of the mixing tool and the peripheral edge is knife-sharp, so that wing-like profiles are formed. On the one hand, an airfoil profile is thus created in a radial direction between the bores and the knife-sharp peripheral edge; on the other hand, an additional airfoil profile is created in a peripheral direction each between adjacent bores. The result of this is that when the rotating mixing tool is immersed in a fluid or in several fluids to be mixed, cyclones develop. A partial vacuum develops at the upper side of the mixing tool, whereby liquid present at the lower side is subjected to a suction effect. One cyclone of fluid per bore develops in the region of the bore on the lower side of the mixing tool. Adhesion forces on the upper side of the mixing tool, combined with a high centrifugal force, cause the fluid to be radially spun away upon flowing through the bores. Cavitation takes place in the range of high shearing forces, predominantly at the knife-sharp peripheral edge. A defined direction of flow is formed by the airfoil profiles in the radial and peripheral directions on the basis of the pressure differences between the upper and lower sides. Moreover, the flow through the bores and the subsequent flow around the upper side of the mixing tool in a radial direction are substantially improved, whereby the suction effect is increased, flow losses are avoided and, thanks to a thereby increased radial flow rate, the cavitation effect and the mixing effect are improved.

BRIEF DESCRIPTION OF DRAWINGS

One embodiment according to the invention is described in greater detail below, with reference to the drawings.

FIG. 2 shows a bottom view of the mixing tool according to FIG. 1, FIG. 3 shows a sectional view of the mixing tool along line 3—3 in FIG. 2.

BEST MODE OF CARRYING OUT THE INVENTION

Figure 1:
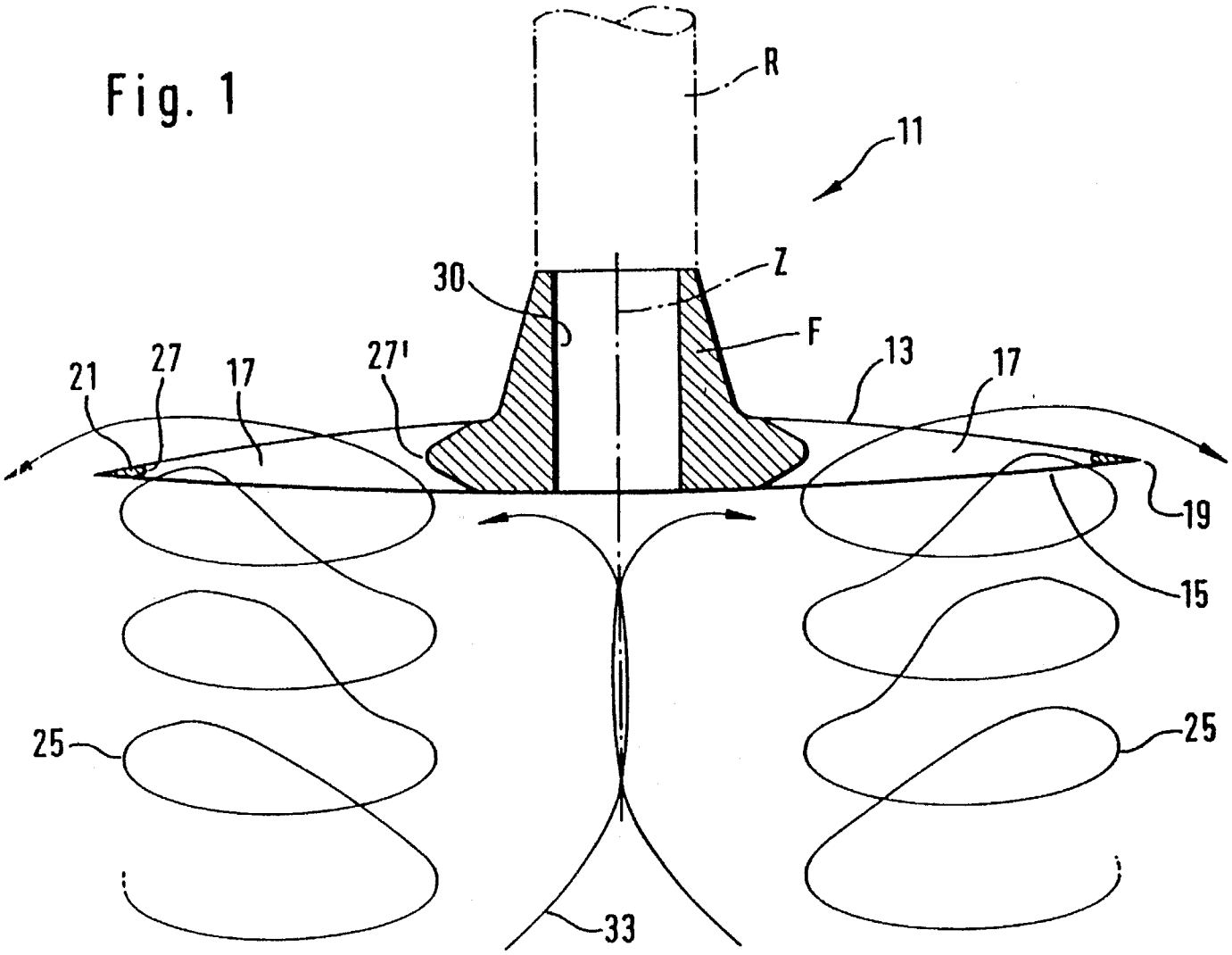
FIG. 1 shows a cross section through an embodiment of the mixing tool according to the invention and two cyclones.

FIG. 1 shows a mixing tool 11 with an upper side 13 and a lower side 15. On the upper side 13 an axially protruding flange F extends centrically with reference to a central axis Z of the mixing tool 11 and has a centric bore 30 via which the mixing tool 11 is coupled to a drive R and can be put into rotation. The mixing tool 11 has a knife-sharp peripheral edge 19 and four axial through bores 17.

The bores 17 are conically bevelled both on the upper and the lower sides 13, 15, for example by a specially designed countersinker with its tip directed towards the central axis Z of the mixing tool 11. In addition, in the areas 27, 27' axially between the bevels, the bores 17 are each rounded off in such a way that the nose of an airfoil profile 21 is formed in a radial direction between the bores 17 and the knife-sharp peripheral edge 19.

The mixing tool 11 has a flat, curved profile on its upper and lower sides 13, 15. The lower side 15 preferably has a more flatly curved profile than the upper side 13, so that the airfoil profile 21 is adapted to an aeroplane wing profile in a radial direction, and thus—as in the lift exerted on an aeroplane wing—a suction effect described in greater detail below occurs, this suction effect being substantially stronger than if the upper and lower sides had been equally curved.

FIG. 2 shows the bores 17 evenly distributed around the periphery of the mixing tool 11 on a circle concentric to the same and each having the same diameter. In addition, however, it is also conceivable for bores 17 of different sizes to be distributed on several concentric circles of the mixing tool 11.

FIG. 3 shows a cut along line 3—3 in FIG. 2 through two adjacent bores 17. Here it can be seen that between the bores 17 in a peripheral direction an airfoil profile 23 is likewise created; it does not have a completely ideal airfoil profile cross section, as the airfoil profile 23 does not taper to a point in a radial direction as does the airfoil profile 21, but rather has radii in the area 27' axially between the bevels. The conical bevels of the bores 17 on the upper and lower sides 13, 15 each lie on the surface area of an imaginary frustum with its line of symmetry outwardly inclined away from the central axis Z of the mixing tool 11. In the production of the countersinks by a countersinking tool, this geometry results from placing the countersinking tool relatively at right angles to the upper and lower sides 13, 15, respectively, which, in the mixing tool 11 with a convex profile, means that the countersinking tool is placed at such a slant that its tip is pointed towards the central axis Z.

Figure 4:
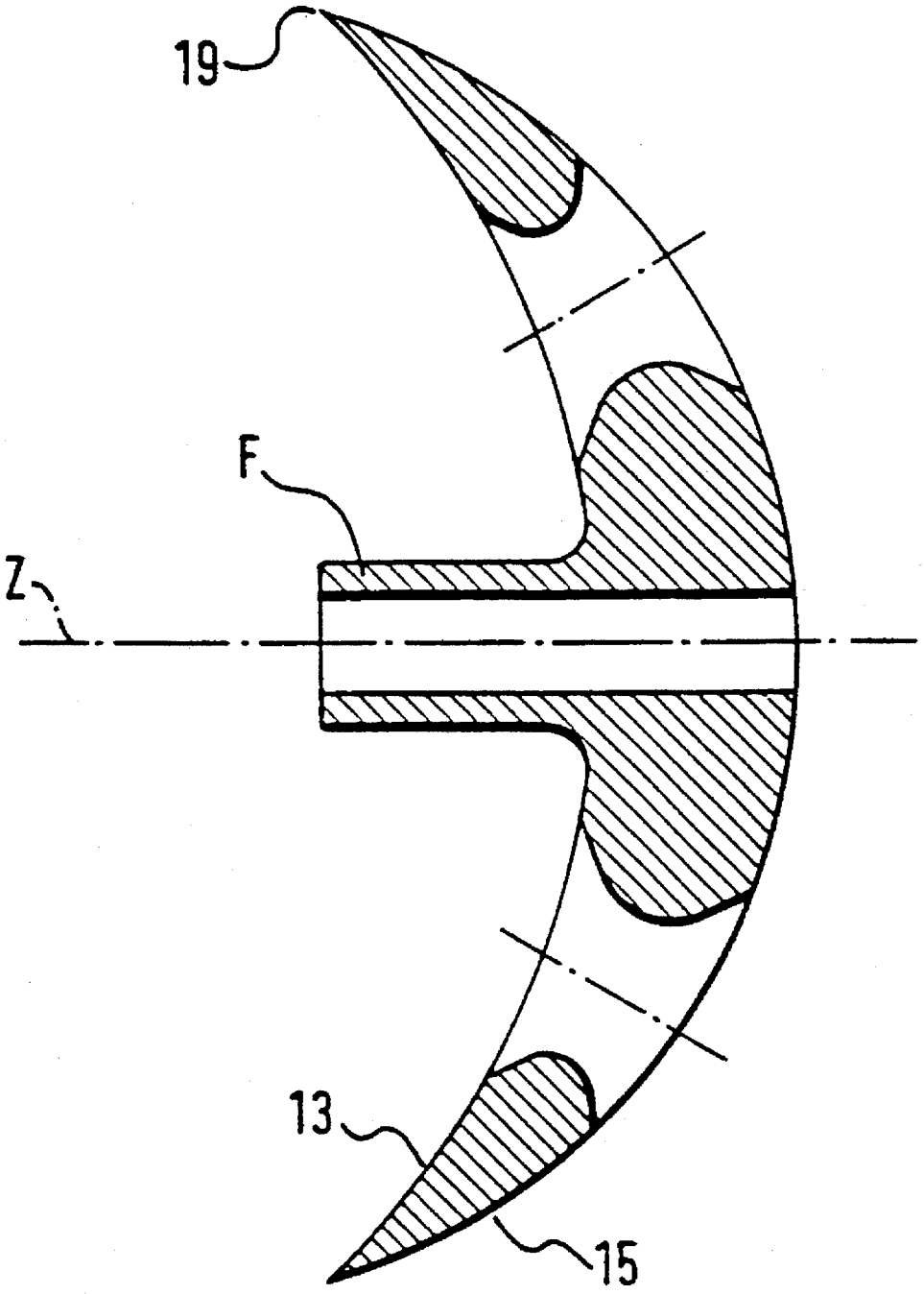
FIG. 4 shows a cross section of another embodiment of the mixing tool according to the invention.

Furthermore, it is possible according to FIG. 4 to concavely curve the upper side 13 axially towards the inside and to convexly curve the lower side 15 axially towards the outside between the central axis Z and the peripheral edge 19. In this case as well, together with the countersinks a wing profile results both in the radial and the peripheral directions.

To be sure, the flange F is advantageous, but it can be omitted altogether and the drive R can be connected by other common coupling elements.

The terms upper and lower sides used here are interchangeable. That would only influence the direction of flow.

The mode of operation of the mixing tool is explained in more detail below on the basis of FIG. 1.

Merely the lower side of the mixing tool 11 is dipped into a not shown container filled, for example, with water and oil, so that the upper side 13 is not wet. The drive R drives the mixing tool 11 so that it rotates, for instance, at approximately 6000 revolutions per minute.

In conventional mixers such as those in the shape of a beater, the mixing is produced by protruding edges which sweep the liquid along. In a beater, which has a twisted screw-like shape, the liquid to be mixed is additionally transported towards the surface of the fluid by a developing conveying effect and, moreover, is spun outwards by the centrifugal force and the protruding edges, whereby the desired mixing takes place.

To be sure, the disc-shaped mixing tool 11 acts like a stirrer, but works in accordance with a different principle. On rotation of the mixing tool 11 a pressure difference between the upper and lower sides 13, 15 develops due to the Bernoulli effect. A resultant partial vacuum at the upper side 13 causes the fluid at the lower side 15 to be drawn in. The suction effect in this is so great that several cyclones 25, similar to whirlwinds, come into being. The number of cyclones 25 corresponds to the number of bores 17 in the mixing tool 11. The diameter of the cyclones 25 is also approximately equal to that of the bores. The fluid thus put in motion flows upwardly at a high rate and flows through the axial bores 17. Due to the adhesion of the liquid to the upper side 13, the fluid is subjected to an additional centrifugal force and is spun radially outwards. Thus the turbulent stream in the region of the cyclones 25 is laminarly aligned upon flowing through the bores 17, resulting in an increased rate of flow on the upper side 13 and, consequently, a higher differential pressure between the upper side 13 and the lower side 15.

The appearing streamline of individual fluid particles is not precisely radial with reference to the mixing tool 11. The superposition of peripheral speed and radial speed results in an arc-shaped flow path of the fluid particles and hence of the fluid in the direction of the peripheral edge 19 of the mixing tool 11. In this the flow around the upper side 13 is smooth and laminar, without major additional turbulence and flow losses, similar to the wing of an aeroplane.

Fluid particles which have flowed through the bores 17 can reach the upper side 13 and be spun outwards not only in the region of the bores 17 which is located near the peripheral edge 19 of the mixing tool 11; it is also equally possible for fluid particles to reach the upper side 13 in the region of the bores 17 which is near the central axis Z. In doing so these fluid particles, as already explained, describe an arc-shaped path towards the peripheral edge 19. On the arc-shaped path as well a stream results, flowing along an airfoil profile representing a combination of the airfoil profile 21 in a radial direction and the airfoil profile 23 in a peripheral direction. This developing airfoil profile has a nose corresponding to the airfoil profile 23 with a relatively large radius in the area 27' between the countersinks and has a rear edge formed by the peripheral edge 19. The airfoil profile 23 is thus not completely engulfed by the flow, but rather forms the nose of the developing airfoil profile, depending on the arc-shaped path described by the fluid particles. This in turn depends on the geometry of the mixing tool 11, its rotational speed and the type of fluids to be mixed.

In the region of high rates of flow, particularly in the region of the peripheral edge 19, high shearing forces within the fluids to be mixed result in the formation of tiny cavitation bubbles, i.e. low-pressure cavities. Cavitation is mechanically produced.

The fluids to be mixed are mixed substantially more rapidly and thoroughly than with conventional stirring means not only through the high rates of flow, but also through the cavitation itself. The tiny cavitation bubbles implode again upon their formation, whereby strong pressure thrusts occur, creating an additional mixing effect. If only the lower side of the mixing tool 11 is dipped into the fluid or the fluids to be mixed, air or gas, if such is present at the fluid surface, is also drawn in. The gas in this is so completely mixed that it is partially dissolved in the mixed fluid. This is explained by the fact that the air penetrates into the tiny cavitation bubbles developing and fills out the cavities thus formed.

Whereas due to the radially outward flow no more fluid at all is present in the region of the flange F when the mixing tool 11 is rotating, an additional stream 33 appears on the lower side 15 in the area of the central axis Z, between the cyclones 25. This stream 33 also develops due to the strong partial vacuum between the upper and lower sides 13, 15. The stream 33 passes near the lower side 15 radially towards the outside and is partially deflected by the cyclones 25 and/or flows radially on the lower side 15 to the peripheral edge 19.

The upper and lower sides 13, 15 have a flat, convexly outwardly curved profile, with a very wide variety of profiles—as in the case of aeroplane wing profiles—as well as different bevels being conceivable. Depending on the type of bevel and profile, a different airfoil profile 21 and/or airfoil profile 23 results. As in an aeroplane wing, however, it is advantageous to provide the lower side 15 with a more flatly curved profile than the upper side 13, whereby in the cavitation disc 11, comparable to the lift effect on an aeroplane wing, an increase in the pressure difference occurs, resulting in an increase in the suction effect arising.

The ratio of the curvature of the upper side 13 to that of the lower side 15 is defined by a ratio of their surface lines. The surface line of the upper and the lower side 13, 15, respectively, passes in this connection through the central axis Z of the mixing tool 11 and connects two diametrically opposed points of the peripheral edge 19, with the flange F being disregarded in this. Mixing tools 11 with a length ratio of upper surface line to lower surface line of from 1.15 to 1.75 have proved to be particularly advantageous, wherein as the nominal rotational speed at which the mixing tool 11 works increases, the ratio of the lengths of the surface lines also advantageously rises.

Prototypes of the mixing tool 11 with diameters of up to 300 mm have shown that with the mixing tool 11 it is possible to completely mix fluids within an extremely short time.

The suction effect occurring in this is so great that it also appears to be conceivable to use the mixing tool 11 as a drive element similar to a rotor or a ship propeller.

Disc-shaped mixing tools 11 with a large length ratio of upper surface line to lower surface line, i.e. with a heavily curved upper side 13 and a more flatly curved lower side 15, can also be used to separate fluids or to eliminate particles from fluids. For instance, it is possible to separate a mixture of oil and water using the mixing tool 11. In doing so, the different densities of the fluids are exploited, since, depending on their density, the fluid particles on the upper side 13 are spun different distances towards the outside, and a correspondingly longer or shorter flight path results.

In one form in which the mixing tool 11 is made of nickel, the tool additionally has a catalytic effect in the production of an oil-water mixture or a petrol-water mixture. The nickel here acts in each case as a catalyst for the separation of hydrogen from the water and thus for the formation of radical OH groups.

I claim:

1. A disc-shaped mixing tool (11) having an upper side (13) and a lower side (15), being rotatable around a central axis (Z) and having several axial through bores (17), with at least one of the two sides (13, 15) of the disc being convex, characterized in that the peripheral edge (19) of the disc is knife-sharp, and wherein each bore (17) has an upper side (13) and a lower side (15), each bore (17) being conically bevelled to form bevels at the upper side (13) and at the lower side thereof (15), so that airfoil profiles are formed between the bores (17) and the peripheral edge (19) in a radial direction and between adjacent bores (17) in a peripheral direction.

2. A mixing tool (11) according to claim 1, wherein a region is defined between the bevels, and wherein the bores (17) are each rounded off axially in the region (27, 27') between the bevels.

3. A mixing tool according to claim 1, characterized in that the bores (17) are uniformly distributed on a concentric circle of the disc.

4. A mixing tool according to claim 1, characterized in that the bores (17) each have the same diameter.

5. A mixing tool according to claim 1, characterized in that the upper and lower sides (13, 15) of the disk each have a flat, convex profile curved axially outwards.

6. A mixing tool according to claim 1, wherein the upper and lower sides (13, 15) each have a curved profile, and wherein the lower side (15) of the disk has a more flatly curved profile than the upper side (13).

7. A mixing tool according to claim 1, characterized in that the upper side (13) of the disk has a concave profile curved axially inwards between the central axis (Z) and the peripheral edge (19), and that the lower side (15) of the disk has a convex profile curved axially outwards.

8. A mixing tool according to claim 1, wherein a first surface line which passes on the upper side (13) of the disk through the central axis (Z) of the disc and extends between diametrically opposed points on the peripheral edge (19) has a first length, and a corresponding surface line which passes on the lower side (15) of the disk has a second length, and the length of the first surface line is 1.15 to 1.75 times the length of the corresponding surface line of the lower side (15).

9. A mixing tool according to claim 1, characterized in that the conical bevels of the bores (17) on the upper and lower sides (13, 15) thereof each lie on the surface area of an imaginary frustum, with the axis of symmetry thereof being inclined in a direction opposite from the disc, outwardly away from the central axis (Z) of the disc.

10. A mixing tool according to claim 1, characterized in that the disk consists of nickel.

* * * * *

UNITED STATES PATENT AND TRADEMARK OFFICE

CERTIFICATE OF CORRECTION

PATENT NO. : 5,490,727

DATED : February 13, 1996

INVENTOR(S) : Gunter Poschl

It is certified that error appears in the above-indentified patent and that said Letters Patent is hereby corrected as shown below:

On title page, item [54] and col. 1, lines 1-2 should read as follows: "DISC-SHAPED MIXING TOOL WITH CONICALLY BEVELED THROUGH BONES" should read --DISC-SHAPED MIXING TOOL WITH CONICALLY BEVELED THROUGH BORES.--

Signed and Sealed this

Twenty-second Day of April, 1997

Bruce Lehman

*Attest:*

BRUCE LEHMAN

*Commissioner of Patents and Trademarks*

*Attesting Officer*